United States Patent [19]

Beyer et al.

[11] 4,009,050

[45] Feb. 22, 1977

[54] TRANSFER MECHANISM

[75] Inventors: Arnold D. Beyer, Newark; Harry X. Tjon, Fremont, both of Calif.

[73] Assignee: Kaiser Aluminum & Chemical Corporation, Oakland, Calif.

[22] Filed: Dec. 18, 1975

[21] Appl. No.: 642,023

[52] U.S. Cl. ..... 134/66; 134/83; 134/126; 134/134

[51] Int. Cl.[2] ..... B08B 3/04

[58] Field of Search ..... 134/66, 83, 126, 130, 134/133–134, 165

[56] References Cited

UNITED STATES PATENTS

| | | | |
|---|---|---|---|
| 1,736,846 | 11/1929 | Cole et al. | 134/83 X |
| 2,745,419 | 5/1956 | Slingerland | 134/130 |
| 2,923,304 | 2/1960 | Vitense et al. | 134/133 X |
| 3,952,698 | 4/1976 | Beyer et al. | 134/68 X |

*Primary Examiner*—Robert L. Bleutge
*Attorney, Agent, or Firm*—Paul E. Calrow; John S. Rhoades

[57] ABSTRACT

An improved transfer device comprised of powered endless surface elements for supporting and moving coated articles in an upright position, such as coated can bodies, from one treatment station, e.g. a coating station to a further treatment station, such as a coating-/curing oven. Various parts of the endless surface elements are arranged at selected levels in a trough through which a suitable aqueous medium, e.g. deionized water, is substantially continuously circulated. The height within the trough of this aqueous medium is advantageously controlled relative to the top surface portions of the endless surface elements so that there will be a substantially continuous cleaning of the endless surface elements as excess coating material moves towards and drains from the lower portions of the article being transported while the article is moved through the trough by way of the endless surface elements.

22 Claims, 7 Drawing Figures

TRANSFER MECHANISM

BACKGROUND OF THE INVENTION

The present invention relates to an article transfer device. More particularly, it is concerned with a transfer device for simultaneously moving or transporting in a substantially continuous manner from a coating station to a coating/curing station or the like a plurality of upright articles, that have been coated, while maintaining the articles in substantially the same upright position they had assumed during passage through the coating station in order to enhance the drainage of excess coating material from the articles prior to entrance of the coated articles into the coating/curing station or heating zone. The instant device constitutes an improvement over the stationary or agitated can handling or plate transfer devices of application Ser. No. 480,807 of Beyer et al., filed June 19, 1974, now U.S. Pat. No. 3,952,698, and application Ser. No. 565,931 of Beyer filed Apr. 7, 1975, as well as those article handling devices shown in U.S. Pat. Nos. 1,583,034; 1,936,279; 2,821,491; 2,295,575; 3,570,504; 3,341,353 and 3,716,468.

It is desirable in order to mass produce commercially acceptable coated metal containers or cans which have been treated with a water-based coating to effect removal from a can of as much excess coating material as is practical within the relatively short travel distance and time period employed to move the coated cans between the coating and the coating/curing stations.

It has been proposed in application Ser. No. 565,931, in order to enhance excess coating drainage, that preparatory to introducing the coated cans into the curing oven, a selective and accelerated drainage of the coating from the can be effected through the medium of a preliminary heat treatment operation of a few seconds duration. This preliminary heat treatment could involve the use of a warm air blow-off device or the like located adjacent the coating station and intermediate the coating station and the curing oven. The instant application is directed to further improving the drainage of excess coating material after it leaves the coating station by the incorporation of an improved combination article transfer and wiper type device in the transport system used to convey coated cans from the coating zone to the coating/curing zone.

As heretofore noted, it is desirable to obtain as much drainage of excess coating material from the articles coated, such as can bodies, as is practical prior to the introduction of the same into the curing oven in order, among other things, to minimize buildup and baking of the coating on and possible malfunction of the curing oven conveyor equipment. On the other hand, it can also be desirable to minimize the travel time between the coating station and the curing oven, but without at the same time aggravating the problems of excess coating buildup and removal.

In the instant case where multiple can bodies move in unison and progressively while in an upright condition from a coating station to a curing station, equipment fouling and contamination can still pose problems, when stationary or even agitated simple transfer plates are employed and reliance for forward movement of the cans depends to a large extent upon the forward pushing and shoving action of the can bodies against each other particularly where a speedup in production is desired. The instant invention is an attempt to improve upon the transfer equipment described in the aforementioned patent applications and, in effect, to enhance the overall operations of such equipment in coating and curing metal cans on a mass production basis.

SUMMARY OF THE INVENTION

The instant invention is directed to improvements in the transfer plate mechanisms used in the coating systems disclosed in the aforementioned patent applications and contemplates the use of an endless surface, e.g. an improved wet roller transfer mechanism for moving the can bodies from one station, e.g. a coating station, to a further station, such as a curing oven in lieu of a stationary or agitating type of transfer plate. In a preferred embodiment of the invention, the transfer device is comprised of a plurality of driven rollers located at different selected levels in a trough through which an aqueous medium is substantially continuously circulated. The level in the trough of this aqueous medium, which can be deionized water, is advantageously controlled so that there will be a substantially continuously controlled cleaning or wiping of selected portions of the rollers at the same time that other portions of the rollers contact the cans and propel the can forward while picking up the excess coating material draining from the portions of the cans in contact with the rollers. Certain of the rollers of the transfer device are selectively inclined to provide appropriate entry and exit ramps or article flow paths into and out of the deionized waterfilled trough.

The portion of the can body in contact with the rollers can also come into slight contact with the deionized water by controlling the level of such water for the purpose of enhancing removal of excessive solvent material that has drained down the inside and/or outside wall surfaces of a can.

DETAILED DESCRIPTION

Figure 1:
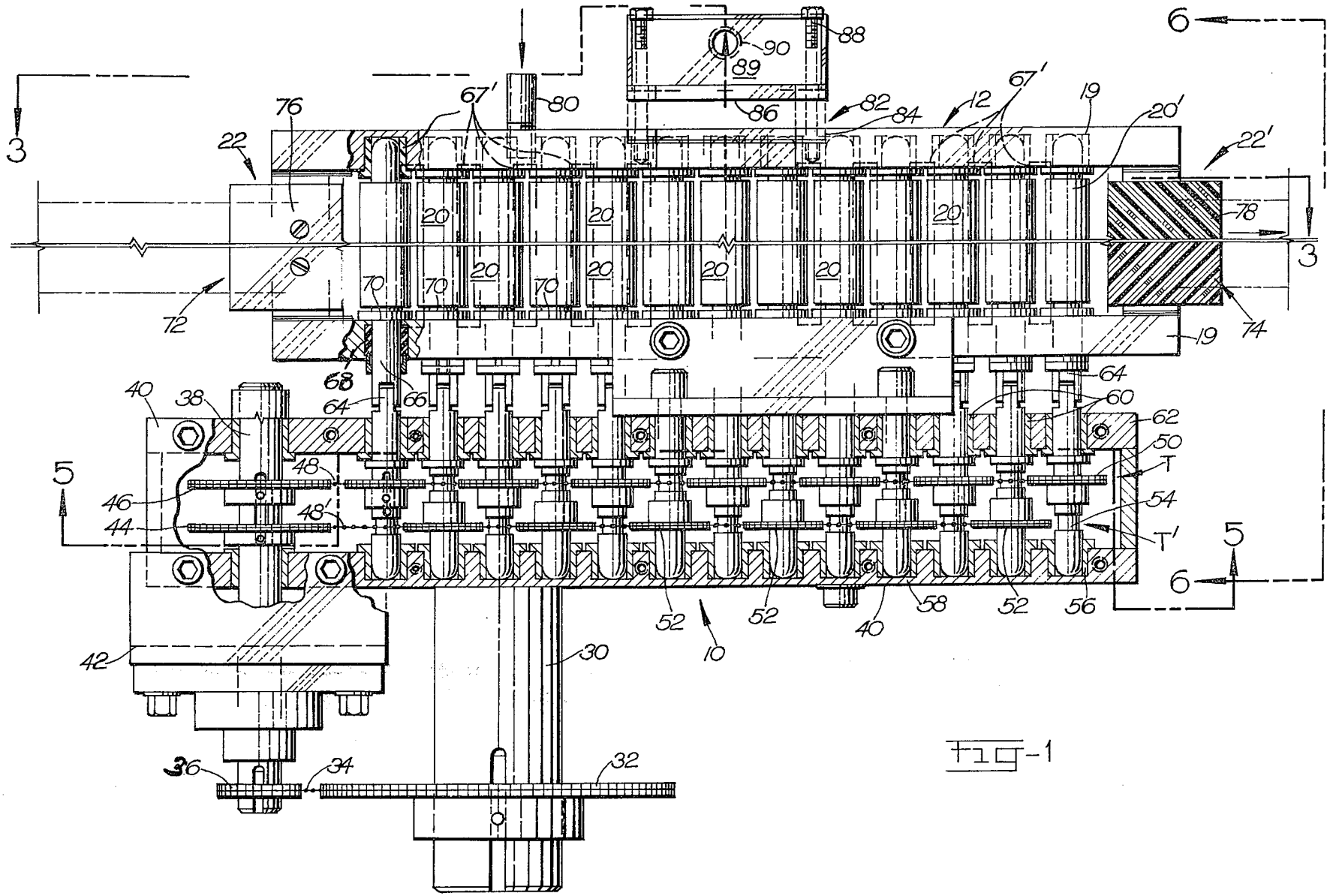
FIG. 1 is a broken and partially cutaway plan view of the improved article transfer mechanism of the instant invention.
Figure 2:
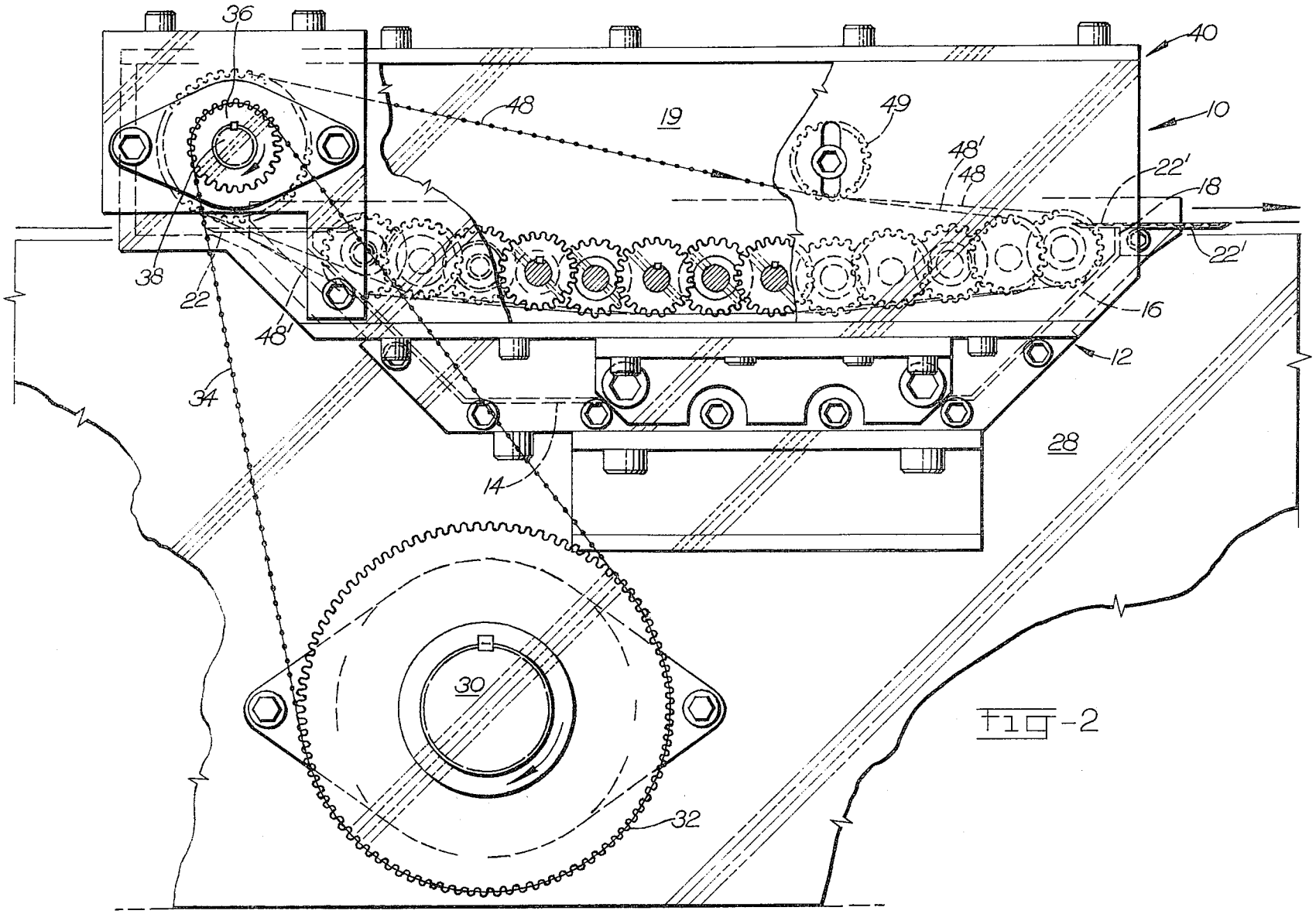
FIG. 2 is a side elevational view of the transfer mechanism shown in FIG. 1 with parts thereof broken away.

With further reference to the drawings and in particular FIGS. 1 and 2, the instant transfer mechanism 10 generally comprises a trough device 12 made up of a sheet metal bottom 14 and inclined end walls 16 that terminate in ledges 18. An appropriately bent and flanged sheet may be used to form bottom 14, end walls 16 and ledges 18 and this sheet can be welded or bolted to and sandwiched between a pair of side plates 19.

Rotatably mounted within the trough is a plurality of rollers 20. In a preferred embodiment of the invention, rollers 20 are mounted in such a fashion that certain of the rollers, such as the rollers of group A, see FIG. 5, have their central axis located along the same slightly inclined plane so as to form an entry ramp for the trough with the rollers in the intermediate group B having their central axis located along the same horizontal plane, while the rollers of the final group C have their central axis generally located along the further slightly inclined plane whereby they can form an upwardly inclined exiting ramp for the cans that move through the transfer device.

Figure 5:
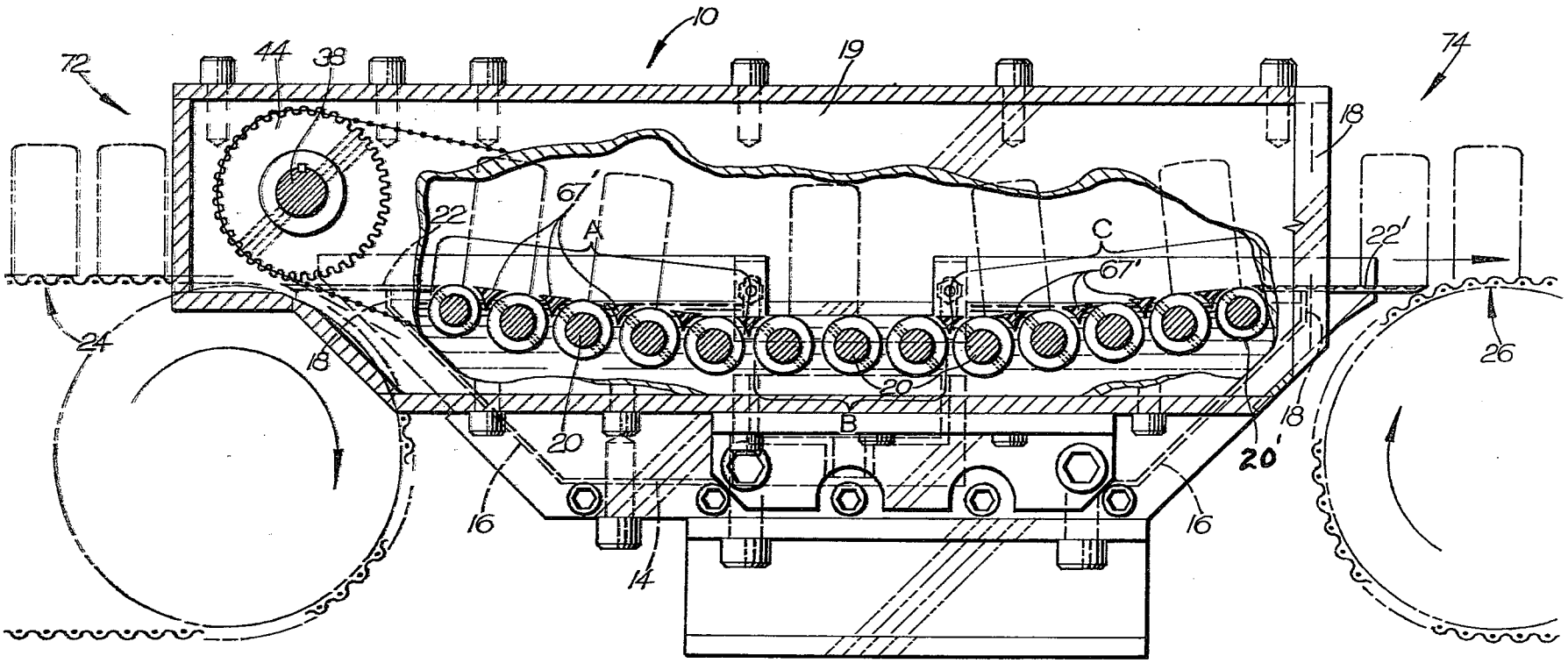
FIG. 5 is a fragmentary cross-sectional view taken along line 5—5 of FIG. 1 with parts broken away, with parts removed and other parts being added and/or schematically shown.
Figure 6:
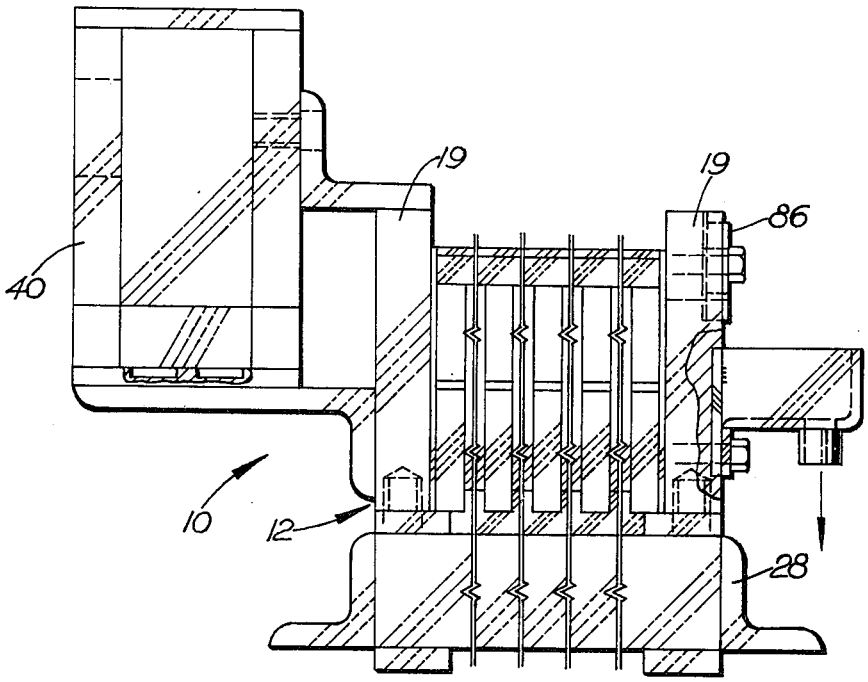
FIG. 6 is a broken end view with parts removed of the transfer device of FIG. 1 when taken along line 6—6 thereof.

Transfer device 10 is further provided with an entry plate 22 and an exit plate 22′ that rest on the opposing ledges 18 while being appropriately secured to side panels or plates 19. As will be discussed more fully hereinafter plate 22′ is grooved. When used in the systems of applications Ser. Nos. 480,807 and 565,931, a meshwork conveyor 24, schematically shown in FIG. 5, can be used to advance the coated cans in an upright condition from the coating zone or station to the transfer device 10 while a similar open mesh conveyor 26, also shown schematically in FIG. 5, is employed to remove the cans from the exit plate 22′ and to transfer and move the same through the coating/curing ovens of the types shown in the aforesaid applications.

The trough device 12 is appropriately supported by the usual table or platform 28. Platform 28 also provides support for a main drive shaft 30 powered by a suitable motor not shown. Keyed to shaft 30 is a main drive gear 32 that is connected by the drive chain 34 to a sprocket gear 36. Sprocket gear 36 is mounted upon and keyed to secondary drive shaft 38 that is supported partly by an elongated gear housing 40 and a secondary support housing 42 attached to a side of the gear housing 40.

Also mounted on shaft 38 and within the confines of gear housing 40 is a pair of small drive gears 44 and 46. Separate drive chains schematically shown in the various drawings and identified as drive chains 48 and 48′ and tensioned by a suitable sprocket assembly 49 are used to drive separate gear trains comprised of the gears 50 in one gear train and 52 in another alternate gear train T and T′. Since each of the gears in each of the gear trains T and T′ is similarly mounted in the gear box or gear holder 40, a description of one such mounting arrangement will suffice for all. It is to be understood that each of the gears 50 and 52 ultimately drives a separate roller 20 in the overall line of rollers. A gear 50 or 52 is mounted on a stub shaft 54, one extremity of which is freely mounted in a standard journal bearing 56 fitted within an appropriate opening in a side wall 58 of the gear box 40. The opposing end of the shaft 54 is fitted within and protrudes from a journal bearing 60 mounted within an appropriate opening in the opposing side wall 62 of the gear box so that it can be connected by a coupling pin mechanism 64 to the spindle 66 for an individual roller 20.

From the above, it will be observed that as the main drive shaft 30 is operated power will be provided through the medium of the sprocket gear 36 and small drive gears 44 and 46 simultaneously to the individual gears in the various trains T and T′ and to all of the rolls 20 mounted in the trough mechanism 12. Rollers 20 are mounted at appropriate and selected elevations in the various side walls 19 of trough device 12 by means of the journal bearings 67 and 68 that can be made from appropriate plastic materials and which are arranged in suitable openings in the respective and opposing side walls 19 of trough device 12.

Article support rollers 20 which bridge the space between trough side walls 19 can be made out of a suitable metal such as stainless steel tubing which is not adversely affected by contact with the aqueous medium in the trough. This contact occurs due to the normally constant partial immersion of portions of the rollers 20 in the aqueous medium as the rollers rotate and the coating material that collects on the rollers from the can bodies supported by the rollers is wiped from the various roller surfaces by the aqueous medium and these roller surfaces are continuously cleaned or renewed. The rollers 20 are appropriately fitted on their respective spindle shafts 66 and arranged in the groupings A, B and C within the trough mechanism 12 intermediate the opposing entry and exit ends 72 and 74. If desired and depending upon the width of the trough 12, the intermediate portions of the rollers 20 can be supported in a manner well known in the art by plastic supports.

The rollers in group A form an entry ramp for articles which are to be advanced through the trough. An intermediate horizontal support is formed by the rollers of group B and a final exit ramp is provided by the rollers making up the group of rollers C of FIG. 5. The rollers in groups A and C are arranged such that their top surfaces are located along inclined planes that are less than the normal tipping angle or the less-than-normal angle of repose of the metal cans being conveyed through the trough 12, e.g. a 3½° angle of inclination so as to avoid tipping of the metal can bodies as they move down and up the entry and exit ramps. Advantageously interposed between the ramp rollers A and C and certain of the horizontal support rollers B is a plurality of somewhat triangularly shaped plastic inserts 67′. These inserts help to provide a quasi-continuous planar surface for the cans moving through the transfer device particularly along the entry and exit ramps and the transition points between the horizontal support formed by the rollers of group B and the inclined ramps formed by the rollers of groups A and C, so as to minimize jamming of a can edge between a pair of rolls 20. The ends of these plastic inserts 67′ are suitably mounted in the side walls 19 of the trough 12 and as in the case of the rolls 20 can be additionally supported at various intermediate points, if necessary, by support elements carried by the trough 12 in a manner well known in the art. These last mentioned support elements as well as the inserts 67′ are to be made of suitable plastic material not adversely affected by contact with the liquid contents of the trough 12, e.g. an aqueous medium. It is to be further understood that the inserts 67′ will be appropriately configured and dimensioned whereby the rolls 20 located on either side of an insert will be free to rotate without binding or interference from an insert 67′.

Figure 7:
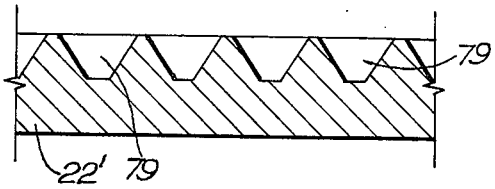
FIG. 7 is a sectional view taken along line 7—7 of FIG. 4.

The platforms 22 and 22′ at entry and exit ends of the trough are provided with metallic platform surfaces 76 and 78 respectively for the can bodies to rest upon in their movement to and from transfer mechanism 12. Surface 78 is advantageously provided with chevron-like grooves 79 for collecting excess drippings of coating material that still tend to accumulate on the bottom or lower portion of the inverted can bodies as they move out of the transfer trough 12 and for discharging such drippings into the trough. As indicated particularly in FIG. 7, the grooved surface 78 can be advantageously saw-toothed in order to provide a minimal surface or a knife edge contact with the open end of a can body. This knife edge contact effects a wiping of the can body edge and helps to remove accumulated excess coating material therefrom by the shearing action resulting from passage of a can body across such surface. Rollers 20 are driven by main drive shaft 30 at a speed slightly in excess of coating station conveyor 24 and slightly less than the speed of conveyor 26 to facilitate the movement of the various can bodies to and from transfer device 10.

In one advantageous embodiment of the invention the rollers 20 can be rotated at a speed whereby the can bodies will travel at a slow rate of about 10 feet per minute through the transfer device 10.

In a preferred embodiment of the invention, the last roller 20' in the group of rollers C, i.e. the roller located immediately adjacent exit platform 22', can have a slightly smaller diameter than the other rollers 20. This means that roller 20' will then rotate somewhat faster than the adjacent roller 20 and thus help to propel the can bodies in contact with roller 20' onto shelf 22' and conveyor 26 and out of the trough 12. Since the surface of platform 22' is grooved as noted, the friction between platform 22' and the can bodies is also reduced and the movement of the can bodies across platform 22' facilitated.

In a further advantageous embodiment of the invention, means are provided for introducing and circulating an aqueous medium through the trough 12 to further assist in collecting and recycling the valuable coating material draining from the can bodies. These means can comprise an inlet pipe 80 for deionized water or the like located in one of side plates 19. The aqueous medium or liquid is introduced into the trough 12 through pipe 80 at the desired low pressure and flow rates. Although as indicated in FIG. 1, pipe 80 is shown as being located on the same side of the transfer trough 12 as a weir mechanism 82 to be described, it could be connected to the opposing side plate 19.

The level of the liquid or deionized water in the trough is controlled by a suitable weir mechanism or assembly 82 somewhat analogous to that of U.S. Pat. No. 3,626,832. This weir mechanism basically comprises an opening 84 in the one side wall 19 preferably on the side that is remote from the drives for the rollers and the gear box 42. A simple gasketed weir gate 86 is adjustably held in the proper position adjacent the opening 84 in side wall 19 and on the outside of the side wall by means of the screws 88. Weir gate 86 controls the level of the deionized water within the trough while still allowing it to spill over the gate at the desired level and into the sump or well 89 provided with a drain 90 that leads to a material recycling system.

Figure 3:
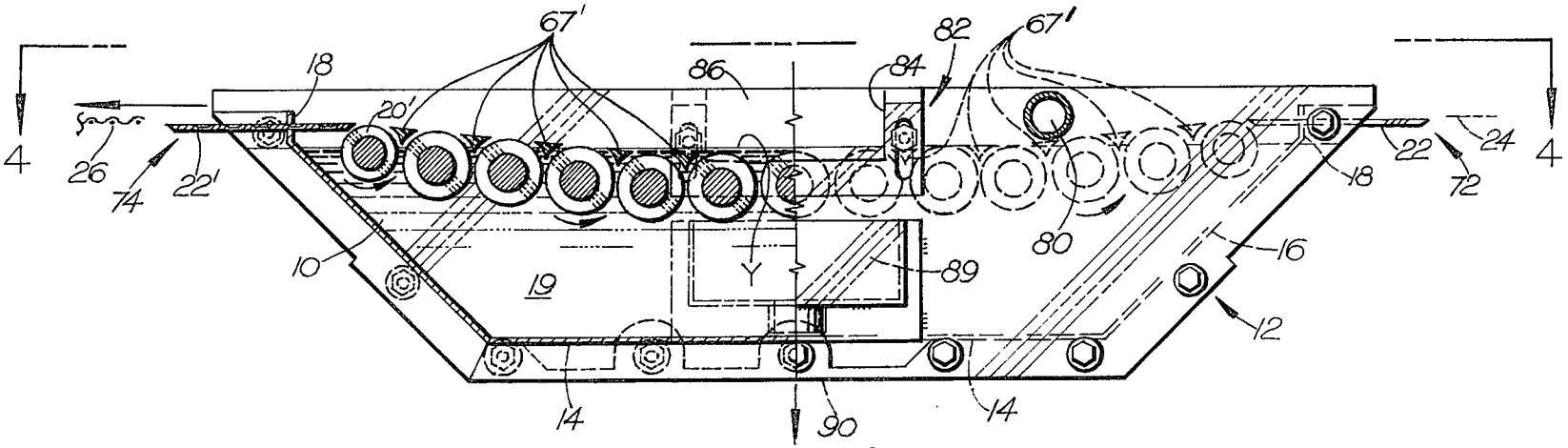
FIG. 3 is a sectional view with parts removed of the transfer mechanism of FIG. 1 when taken along the line 3—3 thereof.
Figure 4:
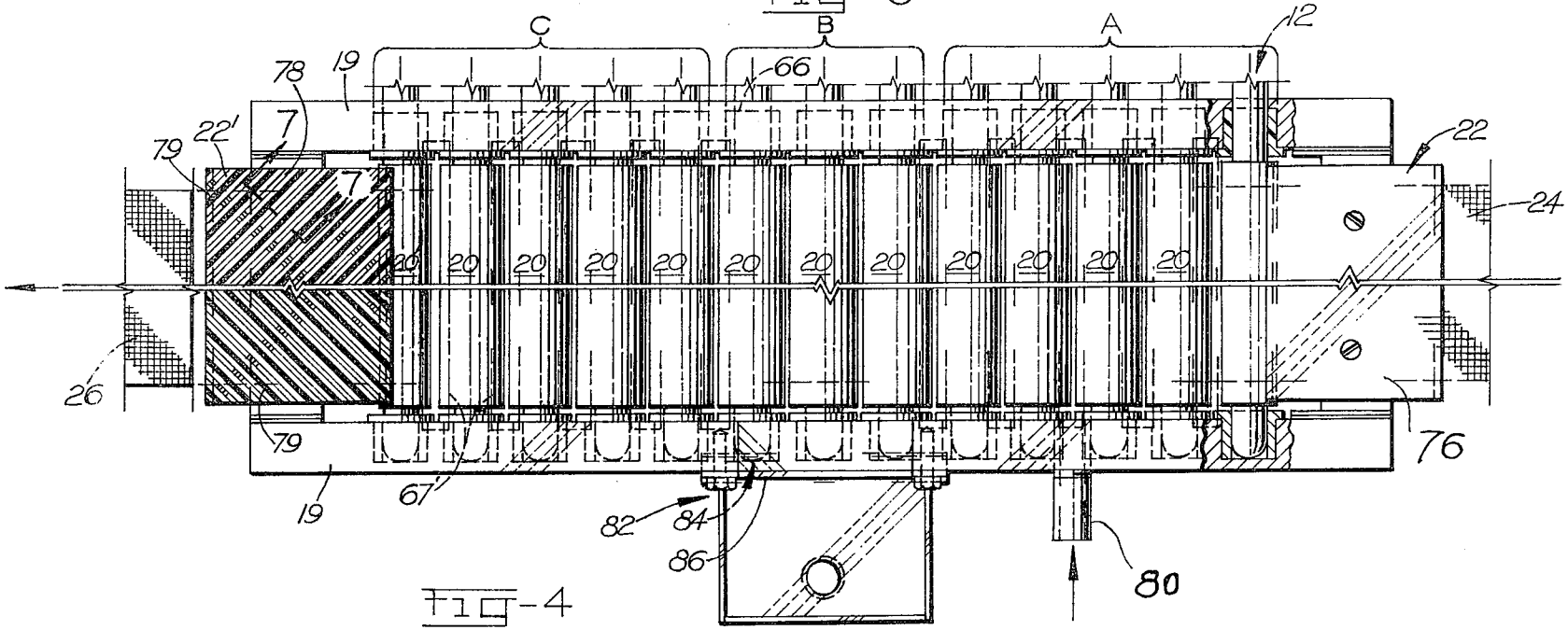
FIG. 4 is a plan view of the roller and trough portion of the transfer device of the instant invention when taken along line 4—4 of FIG. 3.

In a preferred embodiment of the invention and as indicated for example in FIG. 5 the liquid level in trough 12 should be maintained slightly above the top level of the rollers located within the group of rollers B, said level being indicated, for example, by the line Y in FIG. 3. This means that as the deionized water moves through the trough 12 at the desired pressure and flow rates and slightly above the tops of the rollers in the horizontal grouping B, e.g. ¼ to ½ inch, it will slowly circulate about the extreme end portions of the can bodies that are in contact with the tops of the rollers and tend to wipe and dislodge the excess coating material that has drained downwardly from the major surface areas of the can bodies. As noted heretofore, the degree of inclination of the up and down ramps formed by the rollers at the opposing ends of the trough is relatively small and advantageously slightly less than the normal angle of repose or tilt angle of the can bodies. This slight angle does not for all practical purposes adversly affect migration downwardly of the draining coating along the sidewall surfaces of a can body moving through the trough.

It is contemplated that the deionized water that is passed through the trough will be at ambient temperature and contain on the order of from about 0 to 10% solids. While the diameter of the first roller in group A may have the same small diameter as roller 20', the diameter of all rollers used in a preferred embodiment of the invention is such that it is less than the smallest cross-sectional diameter or portion of a can body which is to be carried by the rollers.

Although the raising and lowering of the weir gate mechanism is shown as being adjustable by hand, it is to be understood that its operation can be made fully automatic. For example, it can be electrically controlled by a rack and gear mechanism operated by a suitable reversible motor that in turn is controlled by a sensitive float device disposed in the trough in a manner well known in the art.

It is to be noted that in a preferred embodiment of the invention the saw-toothed ridge elements making up the grooved surface of exit plate 22' are arranged in converging chevron fashion and at selected angles to the normal path of flow of the container bodies across the exit plate. By virtue of this arrangement excess coating material wiped from the lower extremities of the container bodies which pass across the ridge elements will be advantageously directed back into the trough.

From the above, it will be seen that the type of transfer mechanism proposed facilitates the movement of the can bodies from a coating station to a curing oven station of the types disclosed and discussed in the above-noted patent applications while at the same time aiding in removing the excess coating materials that continue to drain by gravity to the lower portions of the inverted cans. All of this helps, among other things, to minimize the collection and accumulation of coating material on the curing oven conveyor that is exposed to the heat of the curing oven and a subsequent baking of the same on and a fouling of the oven conveyor.

An advantageous embodiment of the invention has been disclosed and described and various changes and modifications may be made therein without departing from the claims.

What is claimed is:

1. An article transfer device of the type described comprising the combination of a trough, an article supporting endless surface means disposed in the trough, portions of said surface means being located at selected levels in the trough and providing inclined trough entry and exit ramps, means for effecting movement of said endless surface means so as to provide a forward motion to articles such as can bodies supported in an upright and inverted position on the said endless surface means and a passage of said articles through said trough, means for introducing a liquid medium into said trough and for circulating said medium in the trough and means for controlling the level of said liquid medium in and the circulation of said liquid medium through said trough whereby said liquid medium can be brought into contact with the lower extremities of the articles located in the trough but without adversely affecting the normal upright position of the said articles.

2. A transfer device as set forth in claim 1 wherein portions of the endless surface means that form the trough entry and exit ramps are disposed at selected angles and elevated positions relative to other portions of the endless surface means located in the intermediate part of the trough.

3. A transfer device as set forth in claim 1 wherein said endless surface means comprise a plurality of rollers.

4. A transfer device of the type set forth in claim 3 wherein the rollers have diameters which are less than the smallest cross-sectional portion of the article that is normally directly supported and carried by the rollers.

5. A transfer device as set forth in claim 3 wherein the roller forming the final exit ramp roller is smaller in diameter than the adjacent roller.

6. A transfer device as set forth in claim 3 including a common drive means for all of said rollers.

7. A transfer device as set forth in claim 3 including article supporting and roller bridging inserts disposed intermediate certain of said rollers.

8. A transfer device as set forth in claim 1 including gate means for controlling the level of said medium within said trough.

9. A transfer device as set forth in claim 8 wherein said gate means comprises a weir-like device.

10. A transfer device as set forth in claim 1 including a grooved article supporting surface disposed at the end of the trough exit ramp.

11. A transfer device as set forth in claim 10 wherein the grooved surface is comprised of saw-toothed ridge elements.

12. A combination conveyor and aqueous medium holding device for use in transporting coated container bodies and the like and for removing excess coating material therefrom while said bodies are in a generally upright position comprising the combination of a trough means, a plurality of driven rollers mounted at selected levels in the trough means and providing trough entry and exit ramps, means for continuously driving the said rollers at selected speeds so as to provide a substantially continuous forward movement and passage of the coated container bodies through the trough means while being supported by successive rollers, means for introducing an aqueous medium into said trough means and for circulating said aqueous medium within said trough means whereby certain portions of said rollers will be continuously immersed in said aqueous medium while other portions of the rollers will at the same time contact said container bodies and means for controlling the level of the aqueous medium in the trough means relative to the tops of certain of the said rollers and the lower portions of the container bodies in contact with and supported by the tops of said certain rollers.

13. The device of claim 12 wherein the rollers forming the entry and exit ramps for the trough means are disposed at selected elevated positions and angles relative to the rollers located in the central portion of the trough means.

14. The device of claim 12 wherein the rollers are arranged relatively close together.

15. A device as set forth in claim 12 including roller bridging and container body supporting elements disposed intermediate certain of said rollers.

16. A device as set forth in claim 12 wherein the rollers that form the trough entry and exit ramps are closely arranged and disposed at selected slight angles and elevated positions relative to the rollers mounted in the intermediate part of the trough means.

17. A device as set forth in claim 12 including gate means for controlling the level of said aqueous medium within said trough means.

18. A device as set forth in claim 12 including a grooved container body supporting surface disposed at the end of the exit ramp for the trough means.

19. A device as set forth in claim 18 including article supporting and roller bridging inserts disposed intermediate certain of said rollers and said grooved surface comprising saw-toothed ridge elements disposed at an angle to the normal path of flow of the container bodies across the grooved container body supporting surface.

20. A device as set forth in claim 12 wherein the rollers have diameters which are less than the smallest cross-sectional portion of a container body that is directly supported and carried by the rollers.

21. A device as set forth in claim 12 wherein the roller forming the final exit ramp roller is smaller in diameter than the adjacent roller.

22. A device as set forth in claim 12 including a common drive means for all of said rollers.

* * * * *